US008261586B2

(12) United States Patent
Gartner

(10) Patent No.: US 8,261,586 B2
(45) Date of Patent: Sep. 11, 2012

(54) LOCK ASSEMBLY INCLUDING A ROTARY BLOCKING DEVICE AND TAMPER RESISTANT MECHANISM

(76) Inventor: Klaus W. Gartner, Torrance, CA (US)

( * ) Notice: Subject to any disclaimer, the term of this patent is extended or adjusted under 35 U.S.C. 154(b) by 293 days.

(21) Appl. No.: 12/130,806

(22) Filed: May 30, 2008

(65) Prior Publication Data

US 2008/0276672 A1 Nov. 13, 2008

Related U.S. Application Data

(63) Continuation of application No. PCT/US2006/043879, filed on Nov. 9, 2006.

(51) Int. Cl.
*E05B 47/00* (2006.01)
*E05B 63/00* (2006.01)

(52) U.S. Cl. ..... 70/277; 70/333 R; 70/416; 292/201

(58) Field of Classification Search ..... 70/333 R, 70/416, 277, 279.1; 292/195, 201, 209, 109, 292/341.16, 144, 210, 304; 49/280
See application file for complete search history.

(56) References Cited

U.S. PATENT DOCUMENTS 3,890,813 A * 6/1975 Cothron ..... 70/92
4,899,562 A * 2/1990 Gartner et al. ..... 70/277
4,904,984 A * 2/1990 Gartner et al. ..... 340/543
5,033,282 A * 7/1991 Gartner et al. ..... 70/278.7
5,134,870 A * 8/1992 Uyeda et al. ..... 70/277
5,142,890 A 9/1992 Uyeda et al.
5,473,922 A 12/1995 Bair et al.
5,498,040 A * 3/1996 Silye ..... 292/201
5,778,711 A * 7/1998 Gartner et al. ..... 70/277
6,062,613 A * 5/2000 Jung et al. ..... 292/201
6,098,433 A 8/2000 Maniaci
6,209,932 B1 * 4/2001 Jung et al. ..... 292/216
6,786,519 B2 9/2004 Gartner
7,461,872 B2 * 12/2008 Moon et al. ..... 292/209
2008/0073916 A1 * 3/2008 Min ..... 292/201
2008/0303290 A1 * 12/2008 Yuan ..... 292/195

* cited by examiner

*Primary Examiner* — Carlos Lugo
*Assistant Examiner* — Alyson M Merlino
(74) *Attorney, Agent, or Firm* — Oppenheimer Wolff & Donnelly LLP; Barbara A. Wrigley

(57) ABSTRACT

A lock including a housing having an opening for a locking bolt, a locking bolt movable between a locked position and an unlocked position, an actuator positioned within the housing, and a rotary blocking device that prevents the locking bolt from moving to the unlocked position is disclosed. The lock may optionally include a tamper resistant mechanism that is designed such that attempting to forcibly move the locking bolt from the locked position to the unlocked position while the actuator remains in the locked condition causes the locking bolt to engage the tamper resistant mechanism.

20 Claims, 14 Drawing Sheets

LOCK ASSEMBLY INCLUDING A ROTARY BLOCKING DEVICE AND TAMPER RESISTANT MECHANISM

This application is a continuation of International Application Serial No. PCT/US06/43879 the entirety of which is hereby incorporated by reference.

BACKGROUND OF THE INVENTION

1. Field of the Invention

The present invention relates to locks having a rotary blocking device that prevents a bolt from moving to an unlocked condition and a tamper resistant mechanism that prevents unauthorized access to a safe.

2. Description of the Related Art

Doors of safes, vaults, strong rooms, container and similar security closures (collectively called "safes" in this application) usually have at least one and preferably several safe bolts that reciprocate from a non-locking position to an extended locking position. In the locking position, the safe bolts extend from the safe door into the adjacent safe walls. When the safe has more than one bolt, bolt works connect the bolts. The bolt works include linkages that move the safe bolts simultaneously when a user turns a handle. A locking device cooperates with the bolt works to secure the safe bolts in their extended locking position.

Swing bolt or rotary bolt locking devices mount a bolt for pivoting between locked and unlocked positions. This application refers to the swing bolt within the locking device as the "bolt," "swing bolt," or "locking bolt." The bolts that secure the safe door to the rest of the safe are called "safe bolts." In the locked position, part of the locking bolt projects out of the housing and interferes with a portion of the mechanical bolt works, thereby preventing the bolt works from moving the safe bolts to the unlocked position. When the user enters the correct combination, the lock mechanism allows the locking bolt to pivot to the unlocked position within the housing, thus allowing the user to open the safe door.

Rectilinear bolt locking devices operate in a similar manner. In particular, rectilinear bolt locking devices mount a bolt within a housing for moving between locked and unlocked positions. Thus, instead of pivoting like rotary bolts, linear bolts slide into and out of the locking device housing. When the user enters the correct combination, the lock mechanism allows the locking bolt to slide into the housing. For purposes of explanation and example, the remainder of the background discussion will focus on rotary type locking devices.

In general, a handle on the outside of the safe connects to the bolt works. Rotating the handle initiates movement of the bolt works. If the user enters the correct combination which unlocks or releases the locking bolt, the bolt works can pivot the rotary bolt so that the rotary bolt does not project from the housing. This unlocked position permits the bolt works to continue moving the safe bolts to the unlocked condition, allowing the operator to open the safe. If, however, the rotary bolt is locked, the rotary bolt blocks movement of the bolt works, preventing the bolt works from withdrawing the safe bolts. U.S. Pat. Nos. 5,134,870 and 5,142,890 to Uyeda describe safes using rotary bolts.

The locking mechanism within the lock housing blocks the bolt from pivoting to the unlocked position. Uyeda utilizes a linear solenoid within the housing. Uyeda discloses a solenoid plunger that directly engages the locking bolt. Alternatively, the solenoid plunger engages a locking plate that projects against the bolt. When the plunger or plate engages the bolt, the bolt normally cannot rotate to an unlocked position.

An electronic combination entry system controls the solenoid. Typically, the user enters the combination through a digital input pad. U.S. Pat. No. 5,887,467 to Butterwerk, entitled "Pawl and Solenoid Locking Mechanism," is an example of a lock that uses an electronic key pad on a rotary handle. Rotary input through a dial also can generate an output. Internal circuitry senses entry of the correct combination and sends an electrical signal to the solenoid. The signal causes the solenoid to withdraw a plunger, which, in turn, allows the locking plate to disengage the locking bolt. The user rotates a handle which in turn manipulates the bolt works. Part of the bolt works pushes on the locking bolt to rotate the bolt about a shaft to the unlocked position. The bolt works then withdraws the safe bolts.

Applying sufficient force, such as pounding, jostling, twisting, vibration, or other manipulation, on a locked handle of a safe with a swing bolt lock that is engaged with a plunger controlled by a linear solenoid can sometimes open the safe. This results because the solenoid must be relatively small to fit within the lock housing correspondingly, the plunger is also small and weak. Consequently, sufficient force applied to the handle breaks the plunger. Once the plunger breaks, or is vibrated out of the way, the locking plate moves freely, which allows the swing bolt to pivot open. The bolt works can then be manipulated to withdraw the safe bolts to open the safe.

Uyeda and others have proposed a solution to this problem by using a "safety key" design. The bore of the swing bolt, which rotates about a shaft or axle, is elongated. The elongated opening can move along the bore when one applies a force from the handle through the bolt works on the swing bolt. Thus, the swing bolt can move laterally. Lateral movement causes a notch on the periphery of the swing bolt to engage a safety key in the lock housing. This prevents further force being applied to the swing bolt from transferring to the solenoid plunger or locking plate.

Uyeda also discloses a leaf spring that biases the swing bolt and the bore to a normal position relative to the shaft within the bore. When an unauthorized user tries to force the handle without first entering the correct combination, the notched bolt pushes against and engages the safety key in the housing preventing entry.

The mechanism disclosed by Uyeda is complex and costly to build and assemble. Others have simplified the mechanism, but the structure that biases the swing bolt relative to the shaft or axle remains complex. For example, one conventional swing bolt has a bolt plate mounted in a groove in the swing bolt. The plate has an opening over part of the elongated opening in the swing bolt. A spring within the bolt biases the opening in the plate to one end of the elongated opening. When force is applied to the bolt to cause it to pivot about the solenoid locking plate, the bolt plate slides on the bolt against the spring until the opening in the bolt plate is at the other end of the elongated opening in the swing bolt. This shifts the swing bolt sufficiently to cause the notch of the periphery of the swing bolt to engage the key in the lock housing. The construction of the swing bolt with the sliding plate and internal spring is complex. Assembly is time consuming and costs are high. Furthermore, since the spring is within the bolt, a bearing is created between the shaft and the lock housing instead of between the swing bolt and the shaft, thereby reducing the potential life cycle of the lock.

An alternative design of a lock assembly is disclosed in U.S. Pat. No. 6,786,519 to Gartner. Gartner discloses a solenoid mounted within a housing and a plunger on the solenoid that engages a locking plate. When the lock is in the locked condition, the locking plate engages the locking bolt, preventing the swing bolt from pivoting. When a user enters the correct combination, the plunger disengages the locking plate so that the latter is free to slide out of its engagement with the locking bolt. If an unauthorized user applies sufficient force to the handle through the bolt works against the swing bolt, the intersection of the swing bolt and the locking plate becomes an axis of rotation. The swing bolt rotates slightly on that axis because the opening in the swing bolt through which the shaft extends is elongated. The elongation permits some lateral movement of the swing bolt relative to the shaft. As a result, a single notch on the swing bolt periphery engages a safety key on the housing preventing access.

Unfortunately, safety key mechanisms such as the one disclosed in '519 to Gartner provide insufficient protection against unauthorized access into the safe. Notably, a thin piece of shim stock such as steel may be positioned between the single notch and the safety key when the locking bolt is in the locked position. When the locking bolt is forcibly rotated, the thin shim acts as a "camming" surface, allowing the single notch to bypass the safety key element. As a result, force from the swing bolt may once again be applied against the solenoid plunger or locking plate, potentially resulting in damage to the plunger or solenoid within the lock housing.

Solutions such as those disclosed by Gartner and Uyeda that utilize linear solenoids to control movement of a plunger into and out of a locking bolt or a locking plate provide insufficient protection against "shock." In the locked position, the plunger connected to the linear solenoid is extended such that it engages with, for example, a rotary locking bolt. In the unlocked position, the plunger retracts such that it no longer engages with the locking plate, thereby allowing the locking bolt to freely rotate. A problem arises when the linear solenoid, an electromagnetic device, receives a "shock." Shock can be a result of physical tampering, applied force, vibration, etc. Typically, when a linear solenoid receives a shock, it causes an extended shaft (or in this case, the plunger) to retract in reaction to the shock. This poses a problem because the retraction of the plunger without entering the correct combination would effectively allow unauthorized access into the safe despite the addition of a notch and safety key feature.

Accordingly, there is a need for a lock having a blocking device that is simple to assemble, cost efficient, and that can reliably block access under force and shock. There is also a need for a tamper resistant mechanism that is more effective than the notch and safety key of conventional designs that prevents an unauthorized user from bypassing the safety key element and gaining access to the safe.

BRIEF SUMMARY OF THE INVENTION

The present invention solves the foregoing problems by providing a lock including a housing having an opening for a locking bolt, a locking bolt movable between a locked position and an unlocked position, an actuator positioned within the housing, and a tamper resistant mechanism in the housing. The actuator includes a locked condition engaging the locking bolt and an unlocked condition freeing the locking bolt to move to the unlocked position. The tamper resistant mechanism is designed such that attempting to forcibly move the locking bolt from the locked position to the unlocked position while the actuator remains in the locked condition causes the locking bolt to engage the tamper resistant mechanism.

In another aspect of the present invention, the actuator includes a rotatable cam engagement means with a tab member for engaging with a receiving groove in a blocking device such as the locking bolt. The tab member is configured to rotate between a first position corresponding to the locked position of the locking bolt and a second position corresponding to the unlocked position of the locking bolt.

DETAILED DESCRIPTION OF THE INVENTION

Figure 1:
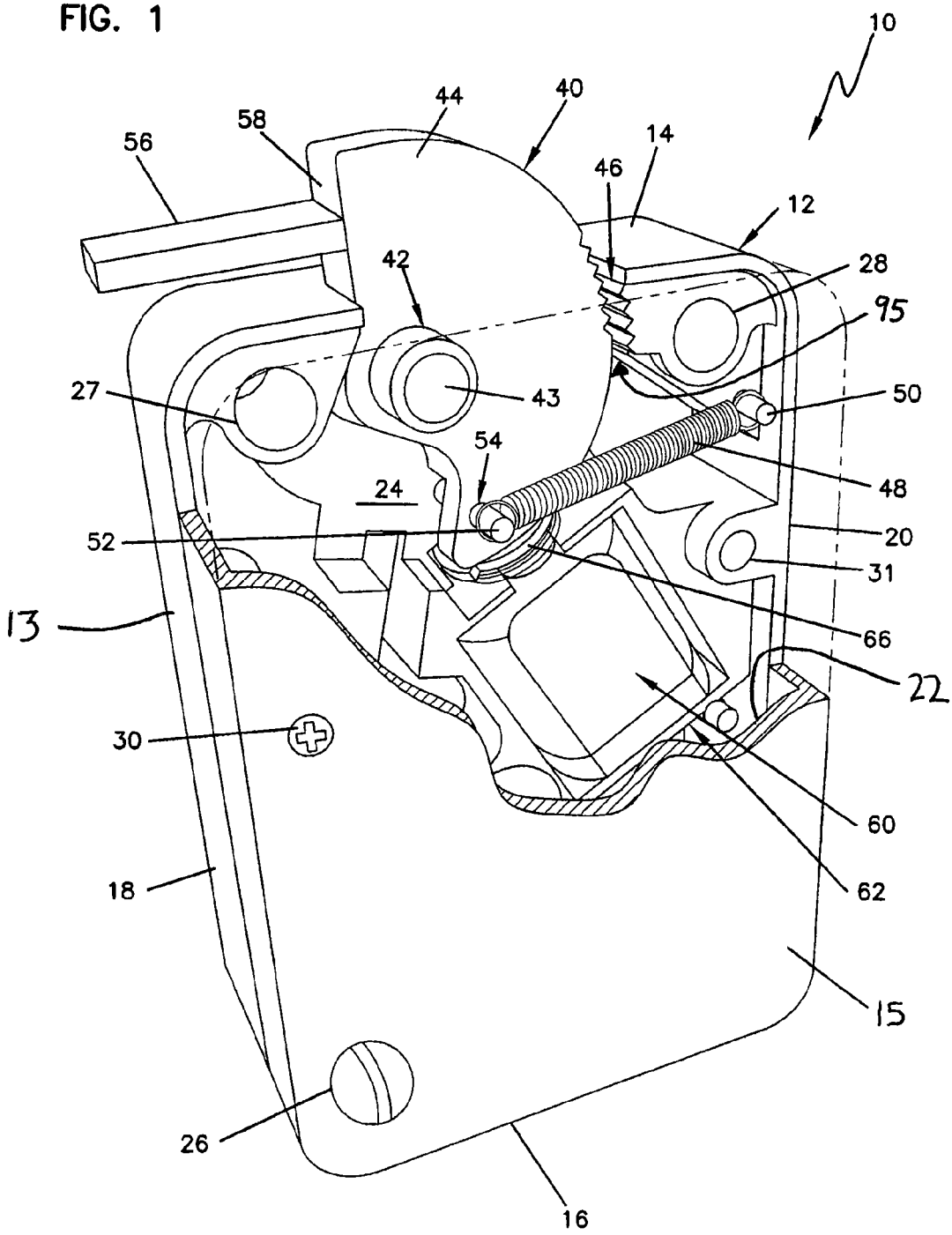
FIG. 1 is a perspective view of a preferred embodiment of a lock according to the present invention.

FIG. 1 is a perspective view of one embodiment of the present invention, broadly including lock 10 including a housing 12, cam engagement means 66, and a locking bolt with a tamper resistant mechanism 95. Housing 12 is commonly brass or another reasonably hard, nonmagnetic metal that can be cast. Housing 12 has a top and bottom 14 and 16 and two sides 18 and 20. The use of "top," "bottom," and "sides" relates to the orientation of the lock in the figures. Each side could become a top or bottom depending on the orientation of the lock in the locked container. As FIG. 1 shows, housing 12 is may be rectangular with curved corners, a common, standard-shaped housing. The size of housing 12 is standardized and is 3¼ in.×2⅜ in. (8.2 cm×6.0 cm). Metric equivalents are approximate and rounded.

Housing 12 includes base 13 having inside wall 24 and cover 15 having inside wall 22. Base 13 of housing 12 attaches to the door of a safe or other secure container. Cover 15 may be removable from housing 12 for repairing various components of lock 10. A plurality of fasteners (only one, fastener 26, is shown) extend through openings such as openings 27 and 28 in base 13 and are threaded into threaded openings in the door of the safe. Thus, the fasteners secure lock 10 to a safe. The spacing of openings 27 and 28 is standardized by different safe manufacturers so that manufacturers' locks are compatible with the safes. For example, the distance between opening 27 and the opening through which fastener 26 may be 2 9/16 in. (6.5 cm), and the distance between openings 27 and 28 is 1 5/8 in. (4.1 cm). Smaller fasteners 30 are threaded into openings such as opening 31 and secure cover 15 to the rest of housing 12.

Referring now to FIG. 1, a locking bolt 40 mounts in housing 12. In the present embodiment, locking bolt 40 is a rotary bolt having a generally D-shape in cross-section. However, it should be understood that various other shapes of locking bolt 40 are contemplated and within the intended scope of the present invention. A shaft receiving opening 42 is positioned near the center of rotary bolt 40. Shaft receiving opening 42 is configured to receive a shaft or axle that mounts within the housing, such as shaft 43 in FIG. 1. Shaft 43 mounts in first and second sleeves (not shown) located on inside walls 24 and 22, respectively, as will be described in more detail below. Shaft receiving opening 42 is generally round and has a diameter that is slightly larger than the diameter of shaft 43. Shaft receiving opening 42 of locking bolt 40 fits onto shaft 43, allowing locking bolt 40 to rotate about the shaft. Thus, a bearing means is formed between opening 42 of locking bolt 40 and shaft 43, which remains generally stationary as locking bolt 40 rotates.

Locking bolt 40 is illustrated in FIG. 1 in a locked position. In the locked position, extended portion 44 of locking bolt 40 extends outside locking bolt opening 46. Locking bolt opening 46 is an indentation in top wall 14 of housing 12 that is typically formed when the housing is cast. Cover 15 may have a narrow flange (not shown) that extends into and forms a boundary or wall of opening 46. In operation, locking bolt 40 rotates to an unlocked position in which extended portion 44 of locking bolt 40 retracts within housing 12. The movement of locking bolt 40 between the locked and unlocked positions will be described in more detail with reference to FIGS. 2A and 2B.

A return spring 48 stretches from pin 50 that extends upward from inside wall 24 of base 13 to another pin 52 that also extends upward from inside wall 24 and through a small opening 54 in locking bolt 40. Tension from spring 48 biases locking bolt 40 counterclockwise with extended portion 44 of bolt 40 in the locked position.

A door handle has a shaft (not shown) that extends through the door of the safe to the bolt works, which control movement of locking bolt 40. Pivoting the handle to an unlocked position manipulates the bolt works. An arm 56 of the bolt works is in contact with camming surface 58 of locking bolt 40. Movement of arm 56 to the right pivots locking bolt 40 to the unlocked position. The handle may be separate from the combination entry device per Uyeda, U.S. Pat. No. 5,142,890, or the combination entry may mount on the handle per Gartner, application Ser. No. 09/664,265, "Combination Lock Handle." Both are incorporated herein by reference.

An actuator 60 mounts inside housing 12. Many different types of actuators may be used including, but not limited to, motors, rotary solenoids, electromechanical rotary devices, and electromagnetic rotary devices. For purposes of example, actuator 60 will be described as a rotary solenoid throughout the remainder of this disclosure. Rotary solenoid 60 mounts in a cavity 62 within housing 12, which is formed by several walls extending upward from inside wall 24 of base 13. The walls forming cavity 62 are typically part of the casting that forms housing 12. Attached to rotary solenoid 60 via a rotary shaft is a cam engagement means including rotary disk 66, a D-shaped in cross-section tab member (shown at 68 in FIG. 2B), and a circular-shaped compression spring (shown at 82 in FIG. 2B). The tab member includes a rounded portion 70 and a flat portion 72, while rotary disk 66 includes a flange-shaped stop member (shown at 73 in FIG. 2B). Tab member 68 engages with a mating surface of locking bolt 40 to help secure the bolt in the locked position. Circuitry within a circuit board (not shown) cooperates with the combination entry device discussed previously. When the user enters the correct combination, the circuitry signals solenoid 60 to rotate solenoid disk 66 by a predetermined amount. As a result, the tab member on disk 66 rotates and disengages with locking bolt 40, while stop member 73 simultaneously rotates and is stopped by an engaging surface cast in housing 12, allowing the bolt to rotate clockwise to the unlocked position.

Figure 2A:
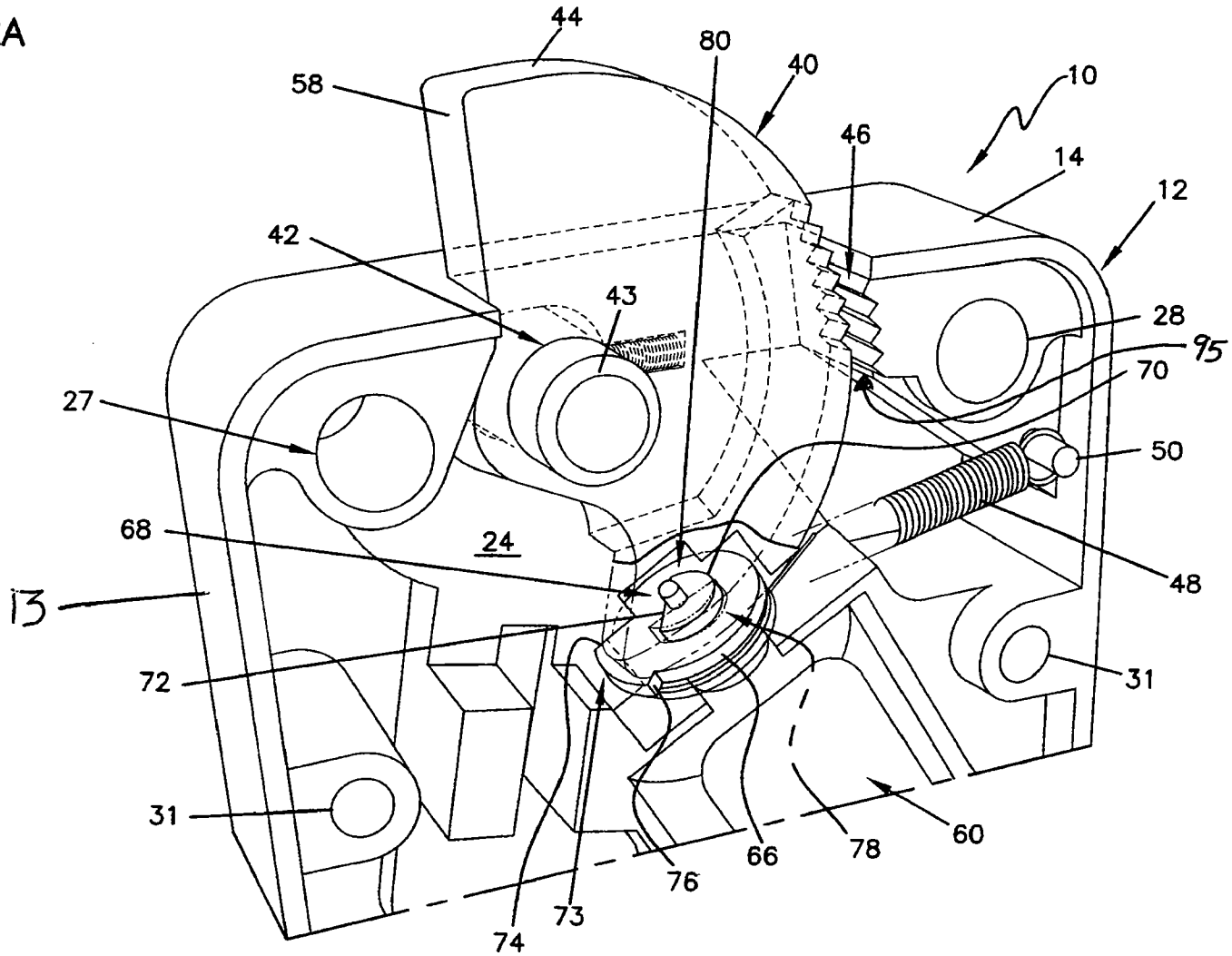
FIG. 2A is a perspective view of the lock of FIG. 1 illustrating a locking bolt in the locked position.

FIG. 2A is a perspective view of lock 10 with a portion of locking bolt 40 cut away to illustrate how rotary solenoid 60 controls movement of locking bolt 40. Disk 66 includes a "D-shaped" in cross-section tab member 68, including a rounded portion 70 on one side and a flat portion 72 on an opposing side. Disk 66 also includes a stop member 73, including a first side 74 for engaging with an outer edge of disk cavity 80 in the locked position, and a second side 76 for engaging with an opposing outer edge of disk cavity 80 in the unlocked position. Locking bolt 40 includes a mating surface having a receiving groove 78 in a side edge of the bolt. Rotary solenoid 60 rotates tab member 68 between a locked position where rounded portion 70 of tab member 68 engages with receiving groove 78 of locking bolt 40 and an unlocked position where rounded portion 70 is rotated within disk cavity 80. In the unlocked position, flat portion 72 of tab member 68 is located adjacent to locking bolt 40. Because flat portion 72 of tab member 68 has no mating surface and does not engage with receiving groove 78 of locking bolt 40, the bolt is able to freely rotate from the locked to the unlocked position.

As shown in FIG. 2A, locking bolt 40 is in the locked position with bolt 40 extended outside housing 12. If the user fails to enter the correct combination or attempts to open the door without entering a combination, rounded portion 70 of D-shaped tab member 68 remains engaged with receiving groove 78 of locking bolt 40. Attempting to rotate the handle causes receiving groove 78 of locking bolt 40 to push against rounded portion 70 of tab member 68. Furthermore, first side 74 of stop member 73 pushes against an outer edge of disk cavity 80, thereby preventing locking bolt 40 from rotating. With first side 74 of stop member 73 in contact with disk cavity 80, tamper resistant mechanism 95 prevents further rotation of locking bolt 40 even when additional pressure is exerted on the handle, as will be described in further detail to follow. An authorized user then will reenter the correct combination.

Figure 2B:
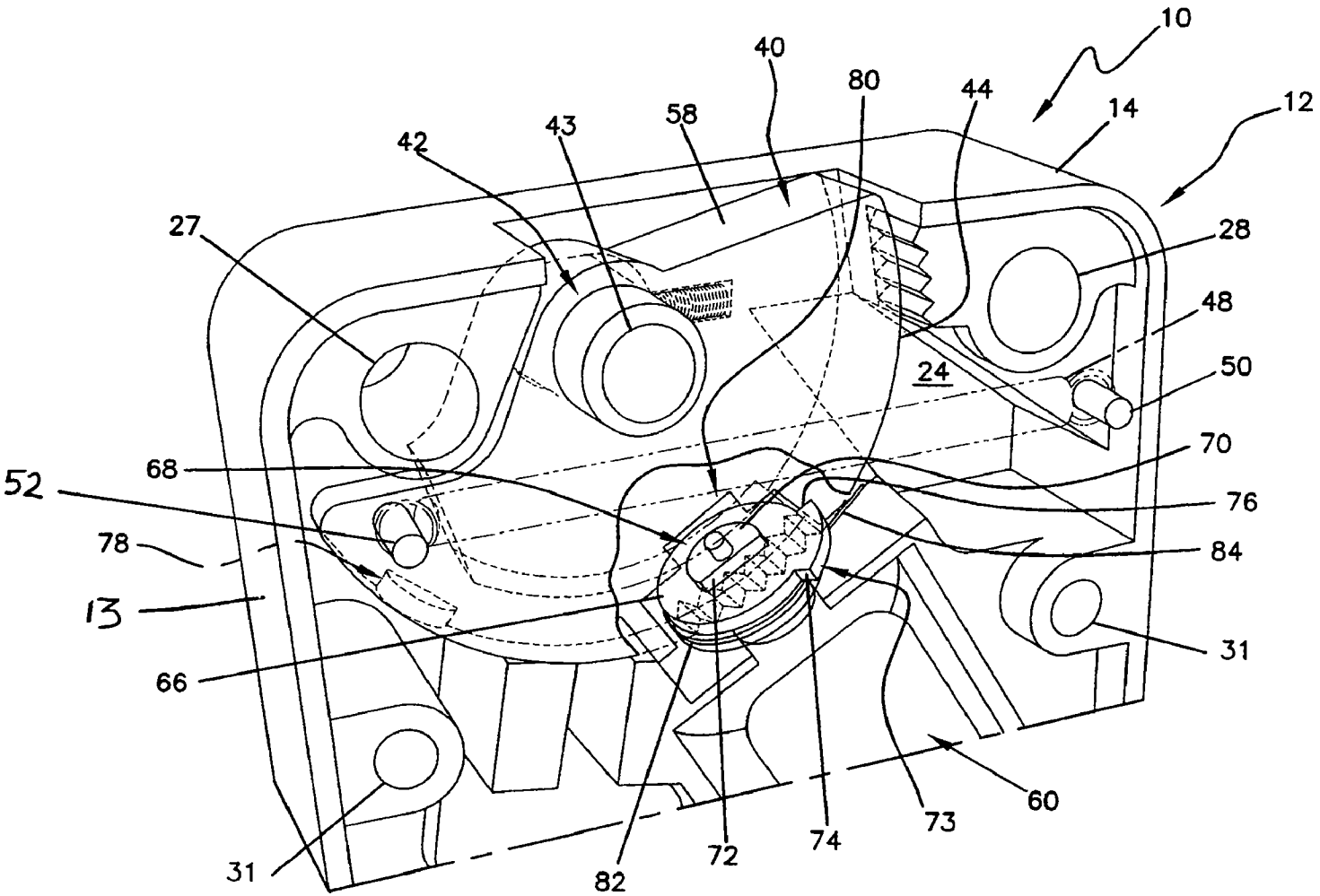
FIG. 2B is a perspective view of the lock of FIG. 1 illustrating the locking bolt rotated to the unlocked position.

FIG. 2B is a perspective view of lock 10 illustrating locking bolt 40 rotated to the unlocked position. In particular, after entry of the correct combination, rotary solenoid 60 rotates tab member 68 so that rounded portion 70 is no longer in engagement with receiving groove 78 on the semicircular edge of locking bolt 40. Instead, tab member 68 rotates such that flat portion 72 of tab member 68 is now adjacent to receiving groove 78. Because there is no longer an interference between disk 66 and locking bolt 40, the bolt may rotate toward the unlocked position as illustrated in FIG. 2B. In the unlocked position, extended portion 44 of locking bolt 40 rotates such that it is completely within housing 12.

As rotary solenoid 60 rotates disk 66 to the unlocked position, flange-shaped stop member 73 correspondingly rotates such that side 76 contacts an opposing edge of disk cavity 80. Thus, stop member 73 properly positions tab member 68 in the unlocked (or locked) position by limiting the angular rotation of disk 66.

As locking bolt 40 rotates clockwise toward the unlocked position, return spring 48 stretches between pins 50 and 52, creating a spring tension that urges locking bolt 40 in the counterclockwise direction. Thus spring 48 biases locking bolt 40 to return to the locked position when a user releases the handle (not shown).

Lock 10 also includes circular-shaped compression spring 82 disposed between disk 66 and rotary solenoid 60. Compression spring 82 includes an arm 84 that rests on the inside of housing 12 near the edge of disk cavity 80. When disk 66 rotates from the locked to the unlocked position, spring 82 compresses, thereby creating a spring tension as would be appreciated by one skilled in the art. Compression spring 82 biases disk 66 in the locked position. Thus, after solenoid 60 stops transmitting its signal that allows locking bolt 40 to unlock by the mechanism described above, disk 66 will automatically return back to the locked position.

Figure 3A:
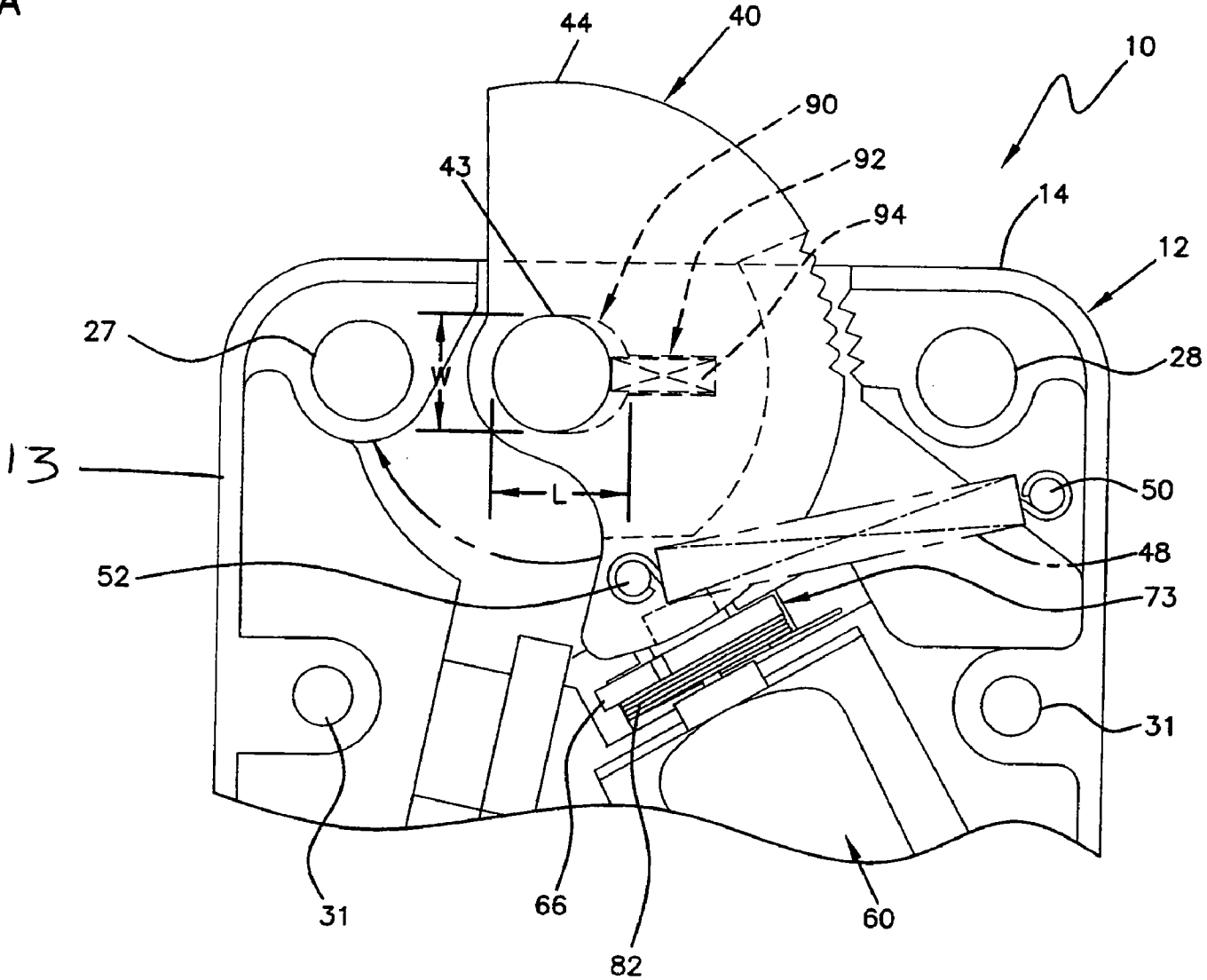
FIG. 3A is a top view of a portion of the lock of FIG. 1 showing the locking bolt in the locked position.

FIG. 3A is a top view of a portion of lock 10 showing a second aspect of the present invention. FIG. 3A depicts locking bolt 40 in the locked position. As shown in phantom lines in FIG. 3A, housing 12 includes rear sleeve 90 positioned towards the back side of locking bolt 40 and is configured to receive shaft 43. Rear sleeve 90 is elongated, having a width dimension W that is less than the length dimension L. Rear sleeve 90 also includes groove 92 configured to receive compression spring 94. A first end of compression spring 94 pushes against the back portion of groove 92. A second end of compression spring 94 pushes against an outer surface of shaft 43, positioning shaft 43 in a normal operating position within rear sleeve 90. In the normal position, locking bolt 40 rotates without obstruction between the locked and unlocked positions when rounded portion 70 of tab member 68 disengages with receiving groove 78 in locking bolt 40.

As can be seen in FIG. 1, wall 22 of cover 15 includes a sleeve (not shown) that is a mirror image of rear sleeve 90. The sleeve in wall 22 is configured to receive a second end of shaft 43, and includes a compression spring that pushes against the outer surface of shaft 43 to maintain the shaft in the normal position within the sleeve. Thus shaft 43 has two springs that bias it in the normal position. It is beneficial to have two springs that bias shaft 43 in the normal position because two springs keep the shaft substantially straight and create a bearing between shaft 43 and locking bolt 40 instead of, for example, between shaft 43 and housing 12, which extends the life cycle of the lock.

Figure 3B:
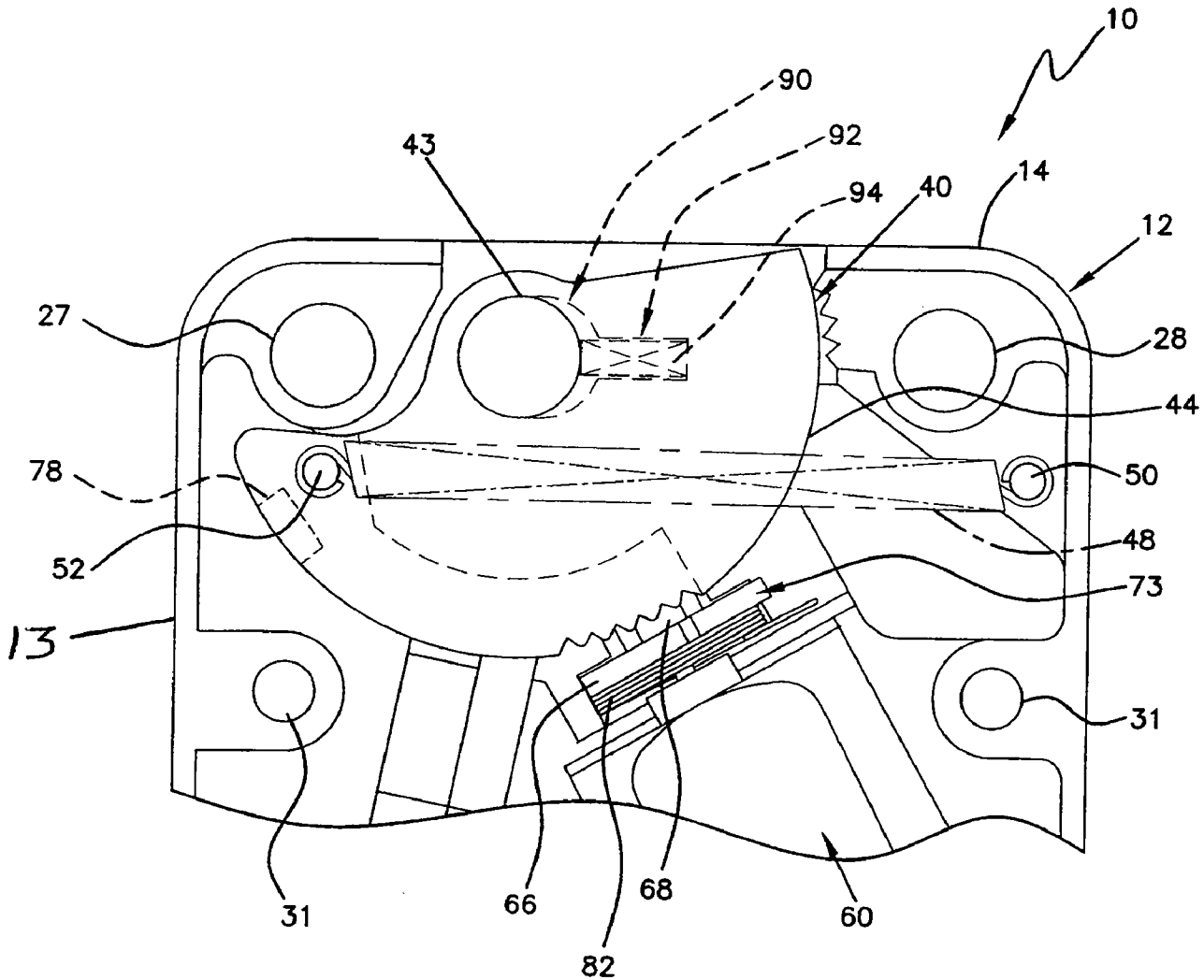
FIG. 3B is a top view of a portion of the lock of FIG. 1 showing the locking bolt rotated to the unlocked position.

Referring now to FIG. 3B, a top view of a portion of lock 10 in accordance with one embodiment of the present invention shows locking bolt 40 in the unlocked position. Locking bolt 40 has rotated clockwise about shaft 43 such that extended portion 44 of locking bolt 40 is disposed within housing 12. As locking bolt 40 rotates about shaft 43, the position of shaft 43 within rear sleeve 90 remains relatively constant (i.e., shaft 43 remains in the "normal" position) due to the force of compression of spring 94 on the outer surface of shaft 43. Therefore, as locking bolt 40 rotates toward the unlocked position, there is enough of a clearance between a plurality of teeth positioned in both locking bolt 40 and housing 12 to allow locking bolt 40 to rotate freely between the locked and unlocked positions without obstruction.

Figure 4:
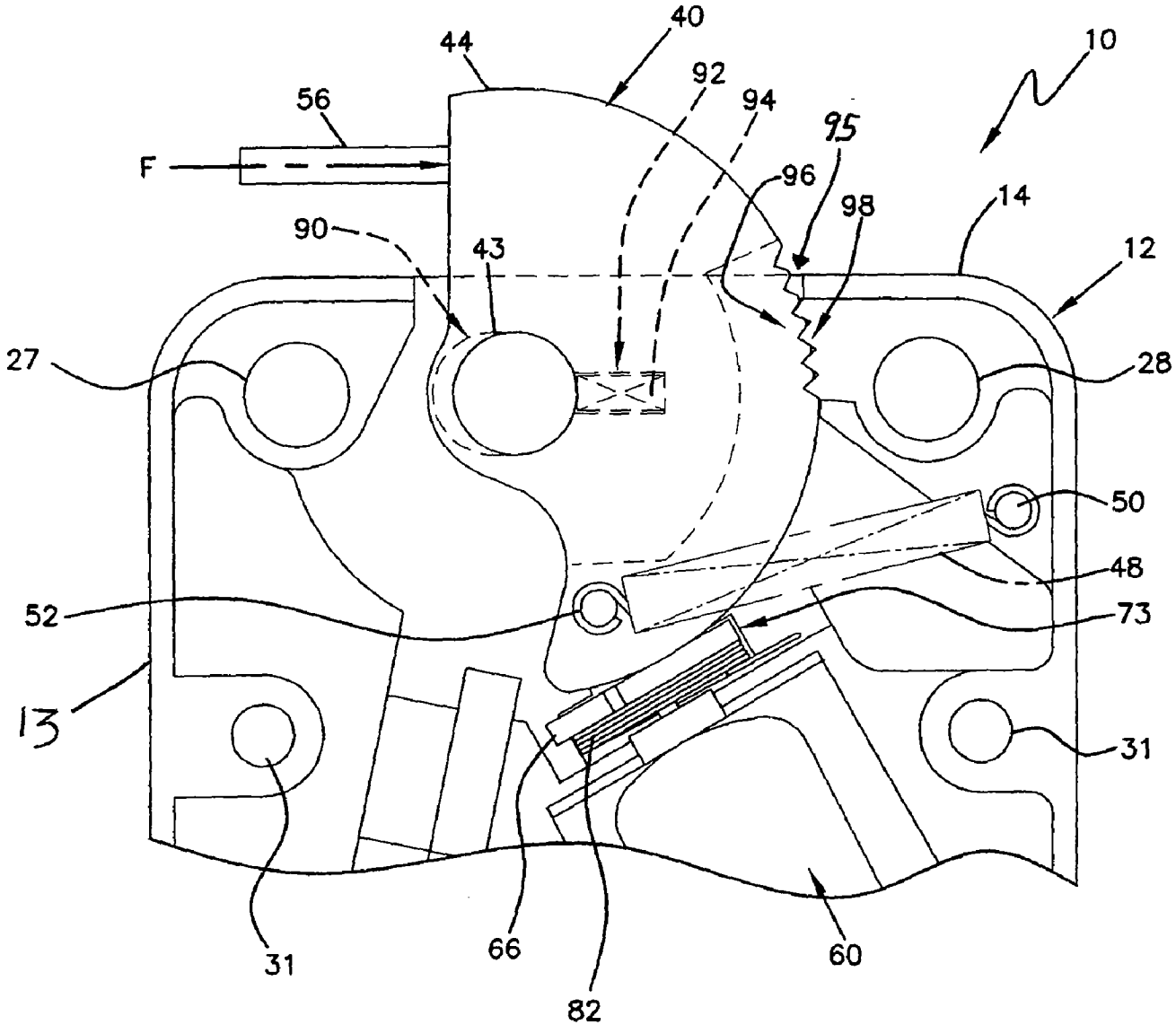
FIG. 4 is a top view of a portion of the lock of FIG. 1 showing the locking bolt of the present invention engaged with the housing.

Referring now to FIG. 4, the "tamper-resistant" mechanism 95 of the present invention is shown. In particular, locking bolt 40 includes a plurality of teeth 96 that are configured to engage with mating teeth 98 in housing 12 positioned near locking bolt opening 46. In one embodiment, the clearance between teeth 96 and teeth 98 is between about 0.005 inches and about 0.015 inches. If a user attempts to force locking bolt 40 to the open position, a force F is applied through arm 56 of the bolt works on locking bolt 40. Because the correct combination has not been entered, rounded portion 70 of tab member 68 remains in contact with receiving groove 78 of locking bolt 40. The force from the handle applies a clockwise torque on locking bolt 40, which in turn causes a force to be exerted on shaft 43. The force exerted on shaft 43 is in the direction of the elongated portion of rear sleeve 90 and moves against the force produced by compression spring 94. As a result, shaft 43 compresses spring 94 and moves toward the right side of rear sleeve 90.

When the user attempts to force locking bolt 40 to the open position, locking bolt 40 moves to the right sufficiently so that teeth 96 of locking bolt 40 engage with teeth 98 in housing 12. Teeth 98 are generally formed as part of the cast brass housing 12, although workers skilled in the art will appreciate that the teeth may be formed from other materials and attached to housing 12. Furthermore, it becomes apparent that even if someone attempts to insert a thin piece of shim stock in between teeth 96 and 98 to "override" the tamper-resistant mechanism, the shim stock will deform as the teeth engage with one another.

When locking bolt teeth 96 engage housing teeth 98, locking bolt 40 is prevented from rotating clockwise. As FIG. 4 shows, locking bolt 40 remains in the unlocked position. This limits the force that locking bolt 40 applies on tab member 68 of disk 66 when rounded portion 70 of tab member 68 is engaged with receiving groove 78. Consequently, locking bolt 40 does not apply enough force to disk 66 to shear off tab member 68 and therefore allow unauthorized access into the safe. A user attempting to force the lock can not rotate locking bolt 40 to the open position nor cause the bolt works to withdraw the safe locks to gain entry to the safe.

Figure 5:
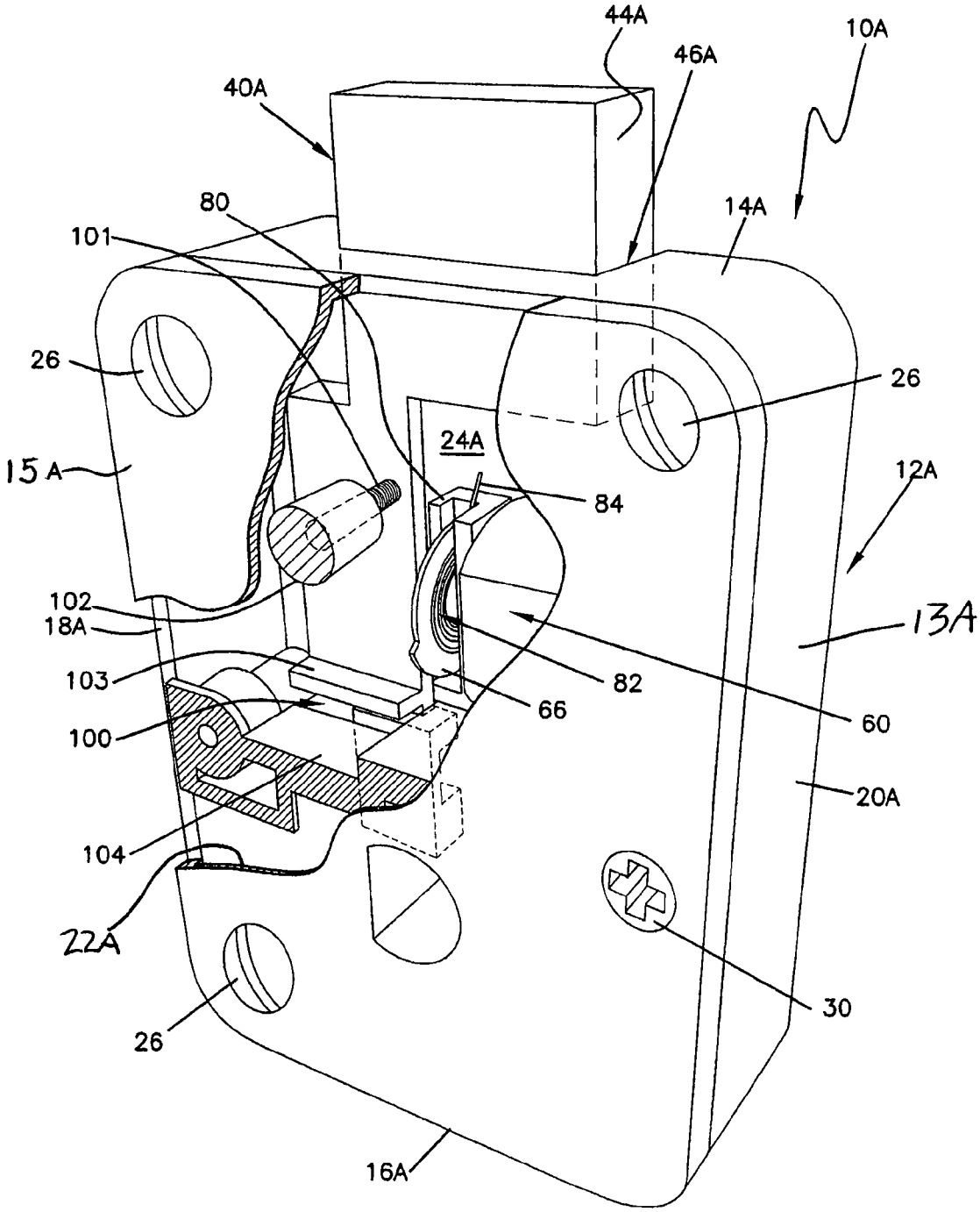
FIG. 5 is a perspective view of a first alternative embodiment of a lock according to the present invention having a locking bolt disposed within a housing.

FIG. 5 is a perspective view of lock 10A, which is an alternative embodiment of lock 10. Similar parts are given similar reference numerals. As shown in FIG. 5, rotary locking bolt 40 has been replaced with linear locking bolt 40A, which is slidable between a locked position in which extended portion 44A projects outside of housing 12A though locking bolt opening 46A and an unlocked position in which extended portion 44A slides within housing 12A.

The position of locking bolt 40A is controlled by rotary solenoid 60, which is the same actuator shown and described above in reference to lock 10. In the locked position, rounded portion 70 of tab member 68 engages with a receiving groove located on a bottom edge of locking bolt 40A. When rotary solenoid 60 is energized, disk 66 rotates a predetermined amount such that flat portion 72 of tab member 68 is now adjacent the receiving groove in locking bolt 40A. At that point, locking bolt 40A is able to freely slide through opening 100 in housing 12A. A spring 101 disposed within spring retention means 102 extends between inside wall 22A of cover 15A and a top side of locking bolt 40A and functions to maintain locking bolt 40A in a normal position wherein the bolt may slide through opening 100 without obstruction.

Locking bolt 40A includes a bolt flange 103 extending generally perpendicular from the bolt toward inside wall 22A of housing cover 15A. Wall 22A of housing cover 15A includes a similar flange 104 extending generally perpendicular toward wall 24A of base 13A. As will be discussed in reference to the following figures, flanges 103 and 104 are configured to engage with one another when the user attempts to force locking bolt 40A to the unlocked position to limit linear movement of the locking bolt and prevent unauthorized access to the safe.

Figure 6A:
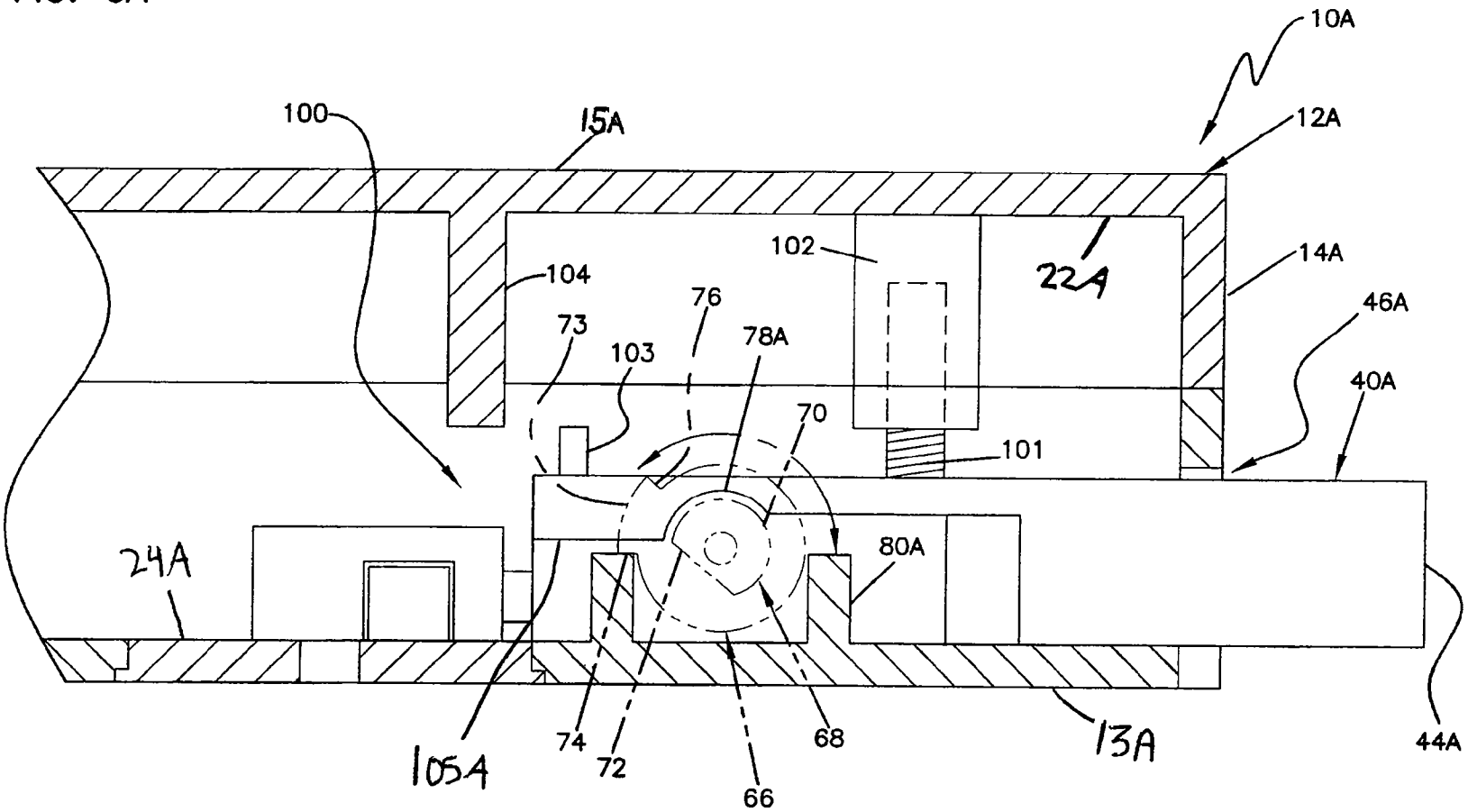
FIG. 6A is a sectional view of the lock of FIG. 5 illustrating the locking bolt in the locked position.

Referring now to FIG. 6A, a sectional view illustrating locking bolt 40A of lock 10A in the locked position is shown. As shown in FIG. 6A, locking bolt 40A includes receiving groove 78A located on bottom edge 105A.

In the locked position, rounded portion 70 of tab member 68 engages receiving groove 78A. If the user fails to enter the correct combination or attempts to open the door without entering a combination, rounded portion 70 of tab member 68 remains engaged with receiving groove 78A of locking bolt 40A. Attempting to rotate the handle (and thus, bolt 40A) causes receiving groove 78A to push against rounded portion 70 of tab member 68. Furthermore, first side 74 of stop member 73 pushes against an outer edge of disk cavity 80A, thereby preventing locking bolt 40A from moving linearly to the unlocked position.

Figure 6B:
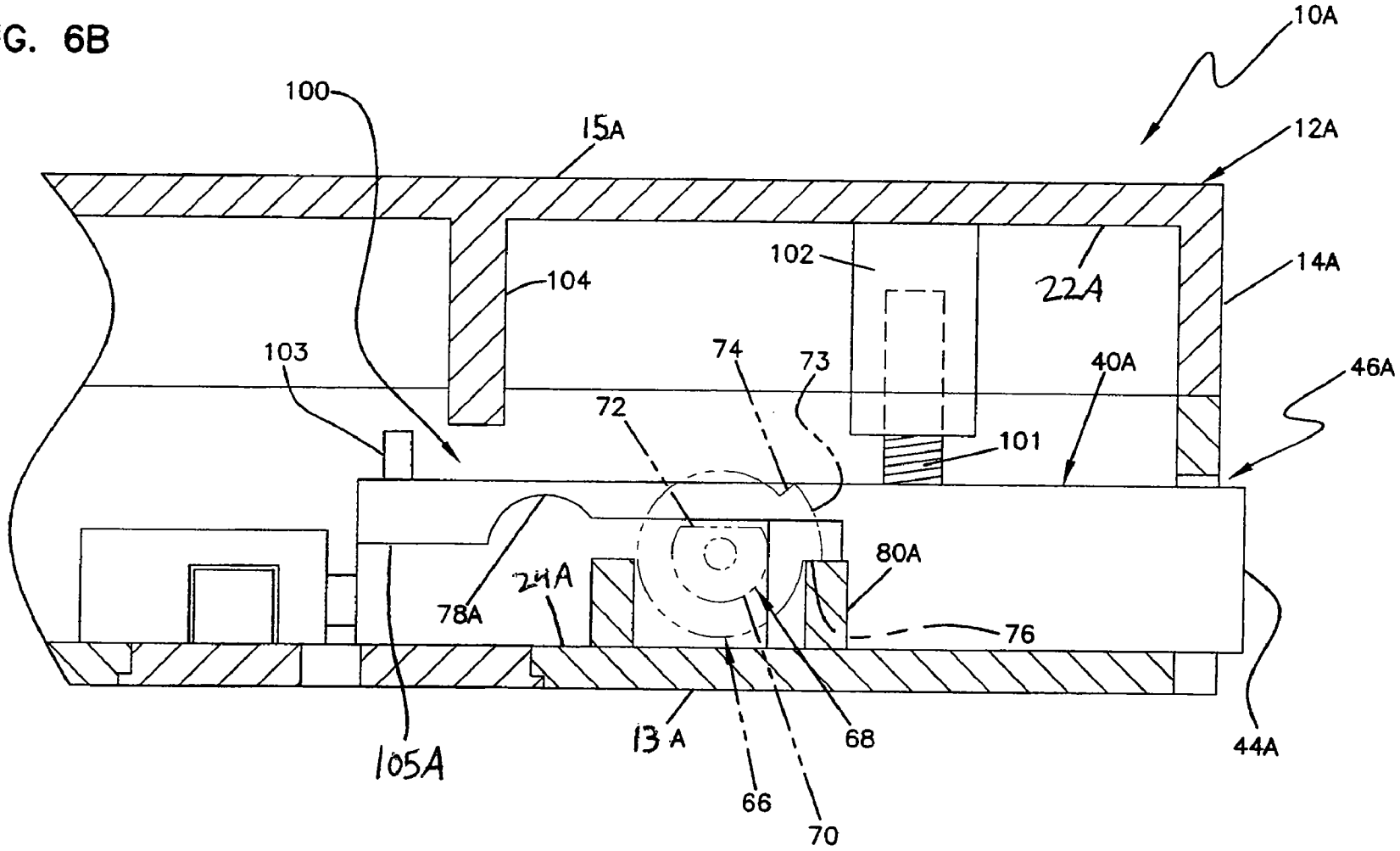
FIG. 6B is a sectional view of the lock of FIG. 5 illustrating the locking bolt in the unlocked position.

FIG. 6B is a sectional view illustrating locking bolt 40A of lock 10A in the unlocked position within housing 12A. In the unlocked position, tab member 68 has rotated such that flat portion 72 is adjacent the bottom edge 105A of locking bolt 40A, allowing extended portion 44A of the bolt to slide linearly into housing 12A when the user rotates the door handle.

Figure 7:
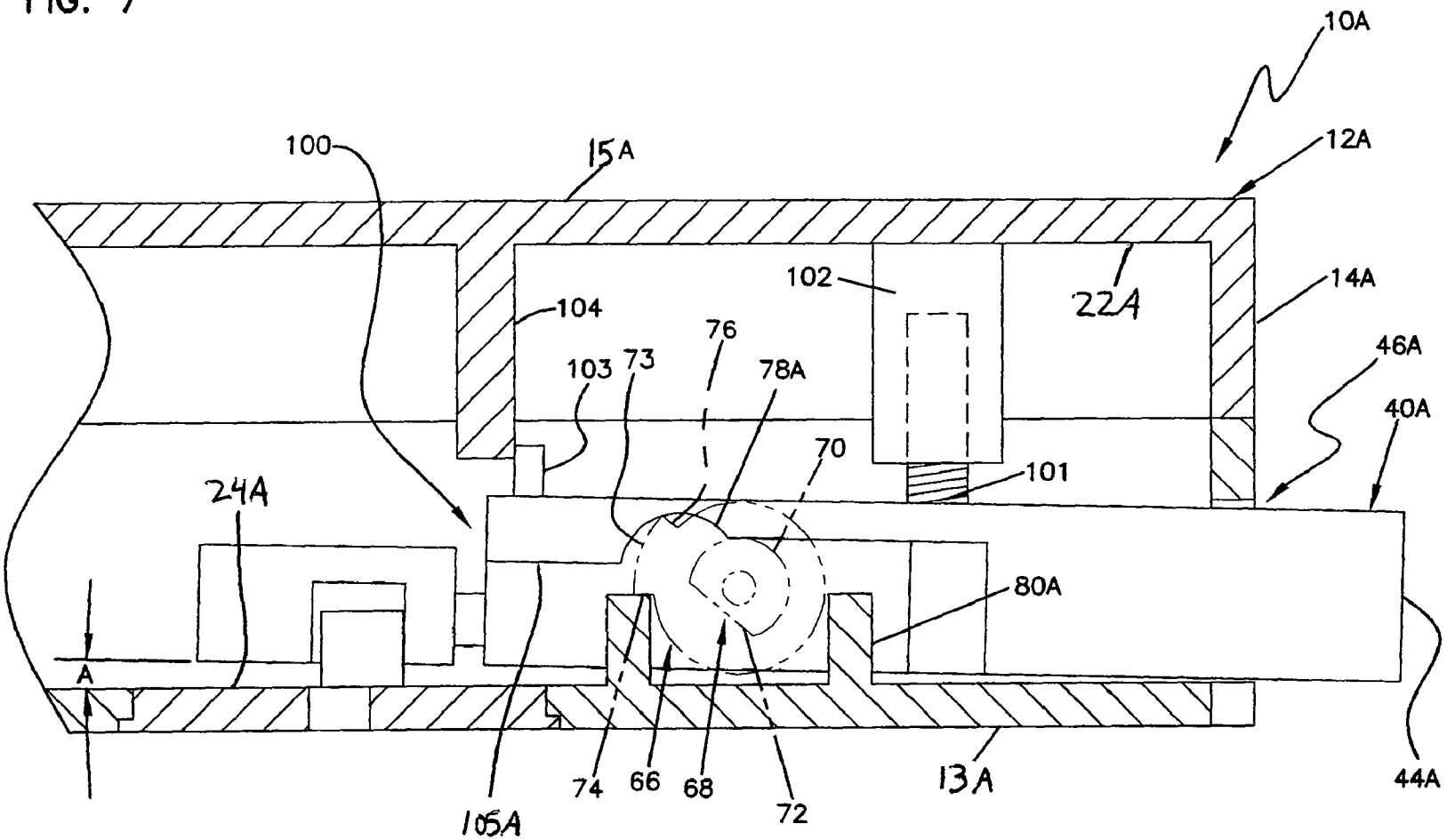
FIG. 7 is a sectional view showing the locking bolt blocked by a tamper resistant block in the housing in accordance with a first alternative embodiment of the present invention.

FIG. 7 is a sectional view illustrating the "tamper-resistant" aspect of lock 10A. If the user attempts to force locking bolt 40A to the unlocked position, he or she applies a force on the bolt. Because the correct combination has not been entered, rounded portion 70 of tab member 68 remains engaged with receiving groove 78A of locking bolt 40A. If sufficient force is applied to locking bolt 40A, the bolt begins to slide toward the unlocked position. However, as locking bolt 40A is sliding toward the unlocked position, rounded portion 70 of tab member 68 acts as a "ramping surface" to the mating surface of receiving groove 78A, causing locking bolt 40A to rise in an upward direction toward inside wall 22A of cover 15A as indicated by angle A.

As can be seen in FIG. 7, bolt flange 103 contacts flange 104 on inside wall 22A of cover 15A, thereby obstructing any further movement of locking bolt 40A toward the unlocked position. This limits the force that locking bolt 40A applies on tab member 68 of disk 66 when tab member 68 is in the locked position. Consequently, locking bolt 40A does not apply enough force onto disk 66 to shear off tab member 68 and therefore allow unauthorized access into the safe. An individual attempting to force the lock, therefore, cannot forcibly slide locking bolt 40A to the unlocked position.

Figure 8:
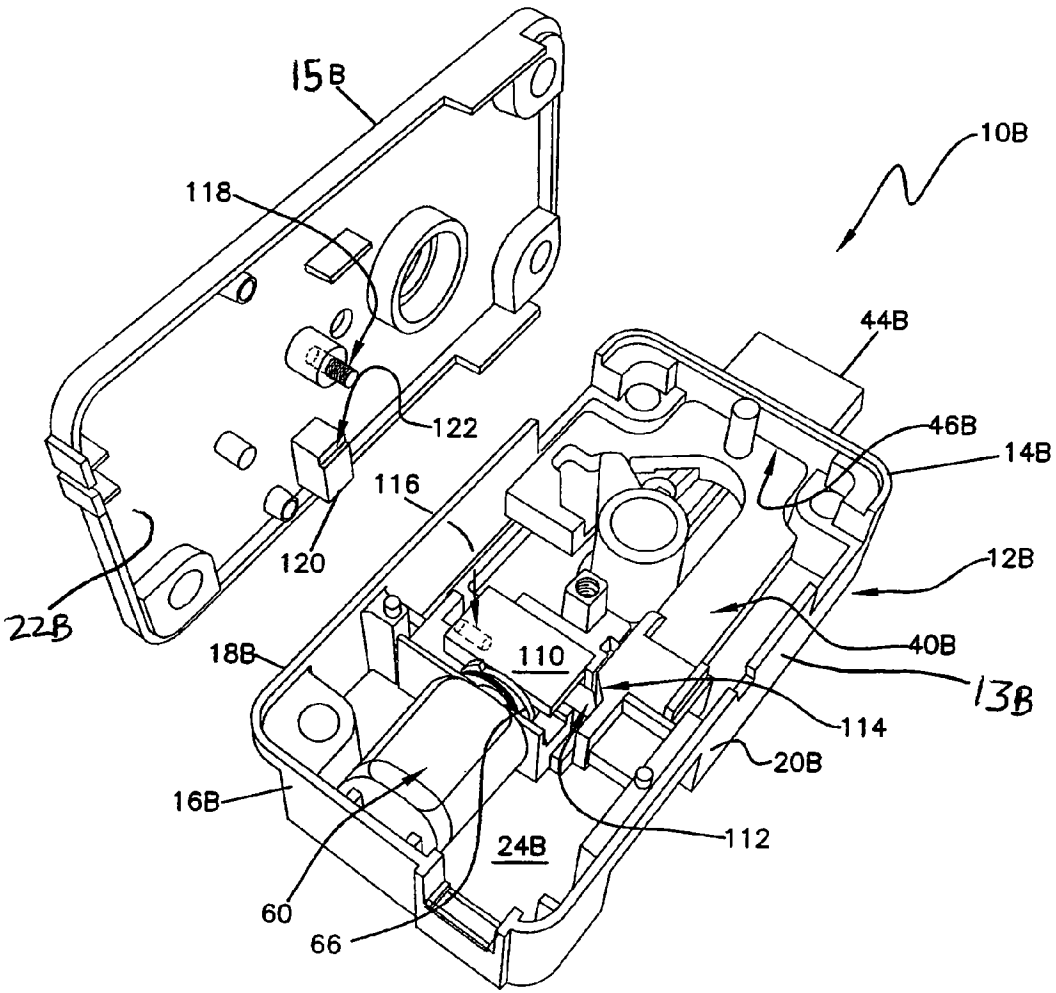
FIG. 8 is a perspective view of a second alternative embodiment of a lock according to the present invention having a linear locking bolt and a blocking member disposed on the housing cover.

FIG. 8 is a perspective view of lock 10B (with cover 15B removed), showing yet another embodiment of the blocking device of the present invention, and wherein similar parts are given similar reference numerals. As shown in FIG. 8, linear locking bolt 40B is slidable between a locked position in which an extended portion 44B projects outside of housing 12B through locking bolt opening 46B and an unlocked position in which extended portion 44B slides within housing 12B. The position of locking bolt 40B is also controlled by rotary solenoid 60. However, unlike locking bolt 40A depicted in FIG. 7, locking bolt 40B does not engage directly with tab member 68 of disk 66. Instead, a separate blocking member 110 is disposed between disk 66 and locking bolt 40B. Thus, one skilled in the art would recognize that tab member 68 may engage with various blocking devices such as locking bolts 40 and 40A or blocking member 110 without departing from the intended scope of the present invention.

Blocking member 110 includes a receiving groove on its bottom side similar to receiving grooves 78 and 78A described above. In the locked position, rounded portion 70 of tab member 68 engages with receiving groove (not shown) in blocking member 110. Blocking member 110 and locking bolt 40B also include cam surfaces 112 and 114, respectively. When blocking member 110 and locking bolt 40B are in their locked positions, as illustrated in FIG. 8, cam surfaces 112 and 114 are in contact with one another.

When rotary solenoid 60 is energized, disk 66 rotates a predetermined amount such that flat portion 72 of tab member 68 is now adjacent to the receiving groove in the bottom side of blocking member 110. At that point, the user may rotate the door handle to move locking bolt 40B to the unlocked position and open the door of the safe. As the user rotates the handle to open the door, cam surface 114 of locking bolt 40B contacts and pushes against cam surface 112 of blocking member 110. Because tab member 68 of disk 66 is no longer in the locked position, locking bolt 40B transfers a force onto blocking member 110 that pushes blocking member 110 toward side 18B of housing 12B (i.e., to the unlocked position). Movement of blocking member 110 causes compression of spring 116 (which spring biases blocking member 110 in the locked position). Second spring 118 is coupled to inside wall 22B of cover 15B and places a spring force on top side of blocking member 110 to help maintain the blocking member in a normal position where it slides between the locked and unlocked positions without obstruction.

As shown in FIG. 8, lock 10B includes a tamper resistant block 120 on inside wall 22B of cover 15B, which protrudes downwardly toward inside wall 24B of base 13B and includes recessed portion 122. As will be discussed in reference to the following figures, recessed portion 122 of tamper resistant block 120 is designed to engage with blocking member 110 when the user attempts to force locking bolt 40B to the unlocked position. Recessed portion 122 limits linear movement of the locking bolt and prevents unauthorized access into the safe by engaging blocking member 110.

Figure 9A:
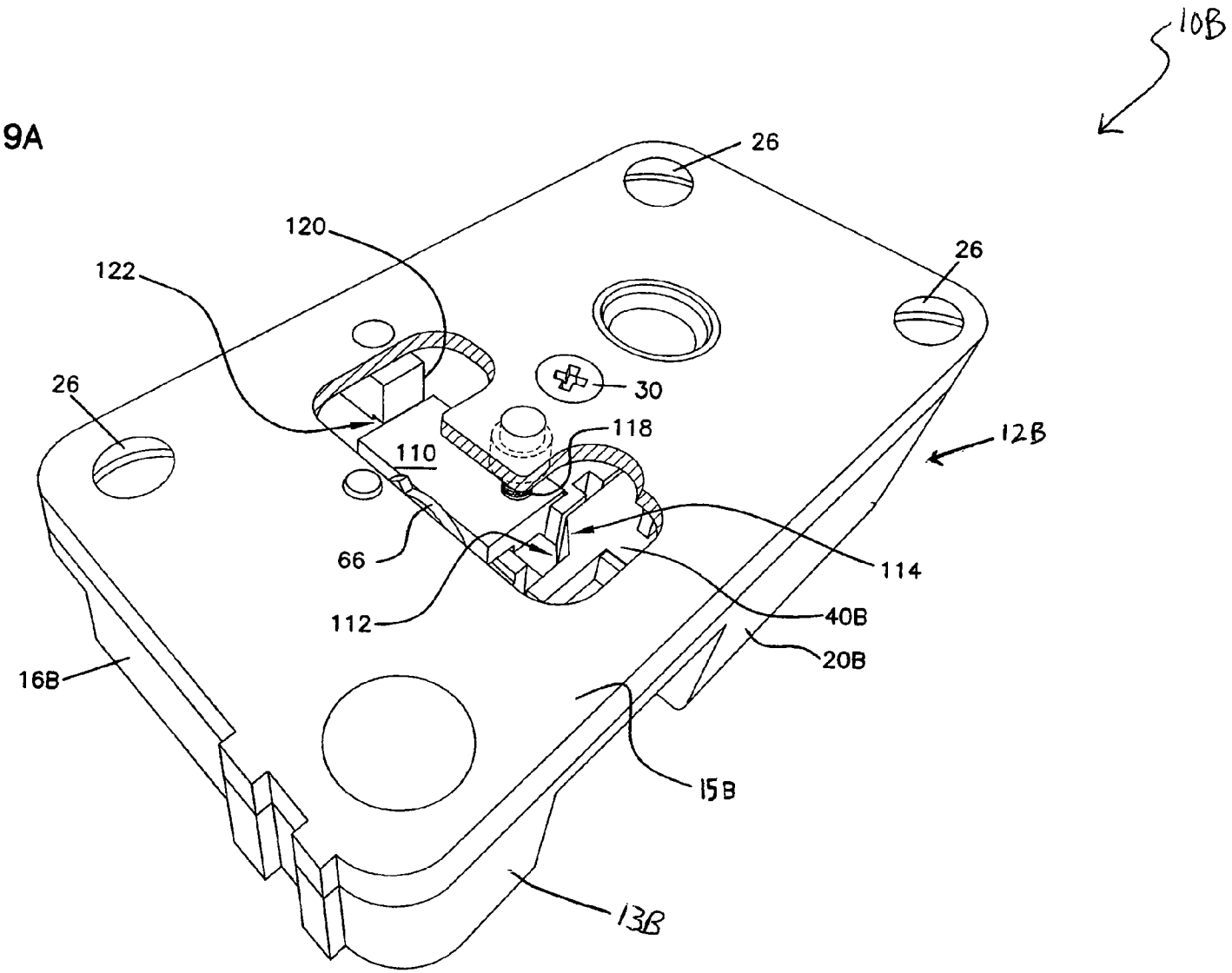
FIG. 9A is a perspective view of the lock of FIG. 8 with the housing cover in its normal position illustrating the locking bolt and the blocking member in their locked positions.

Referring now to FIG. 9A, a perspective view illustrating locking bolt 40B and blocking member 110 of lock 10B in their locked positions is shown. In the locked position, rounded portion 70 of tab member 68 engages the receiving groove in the bottom edge of blocking member 110. If a user fails to enter the correct combination or attempts to open the door without entering a combination, rounded portion 70 of tab member 68 remains engaged with the receiving groove in blocking member 110. Attempting to rotate the handle (and thus retract locking bolt 40B) causes cam surface 114 of locking bolt 40B to push against cam surface 112 of blocking member 110. As a result, the receiving groove in blocking member 110 pushes against rounded portion 70 of tab member 68, thereby preventing blocking member 110 from sliding to the unlocked position. Because blocking member 110 remains in the locked position, locking bolt 40B cannot slide linearly to the unlocked position, and the user is unable to open the door.

Figure 9B:
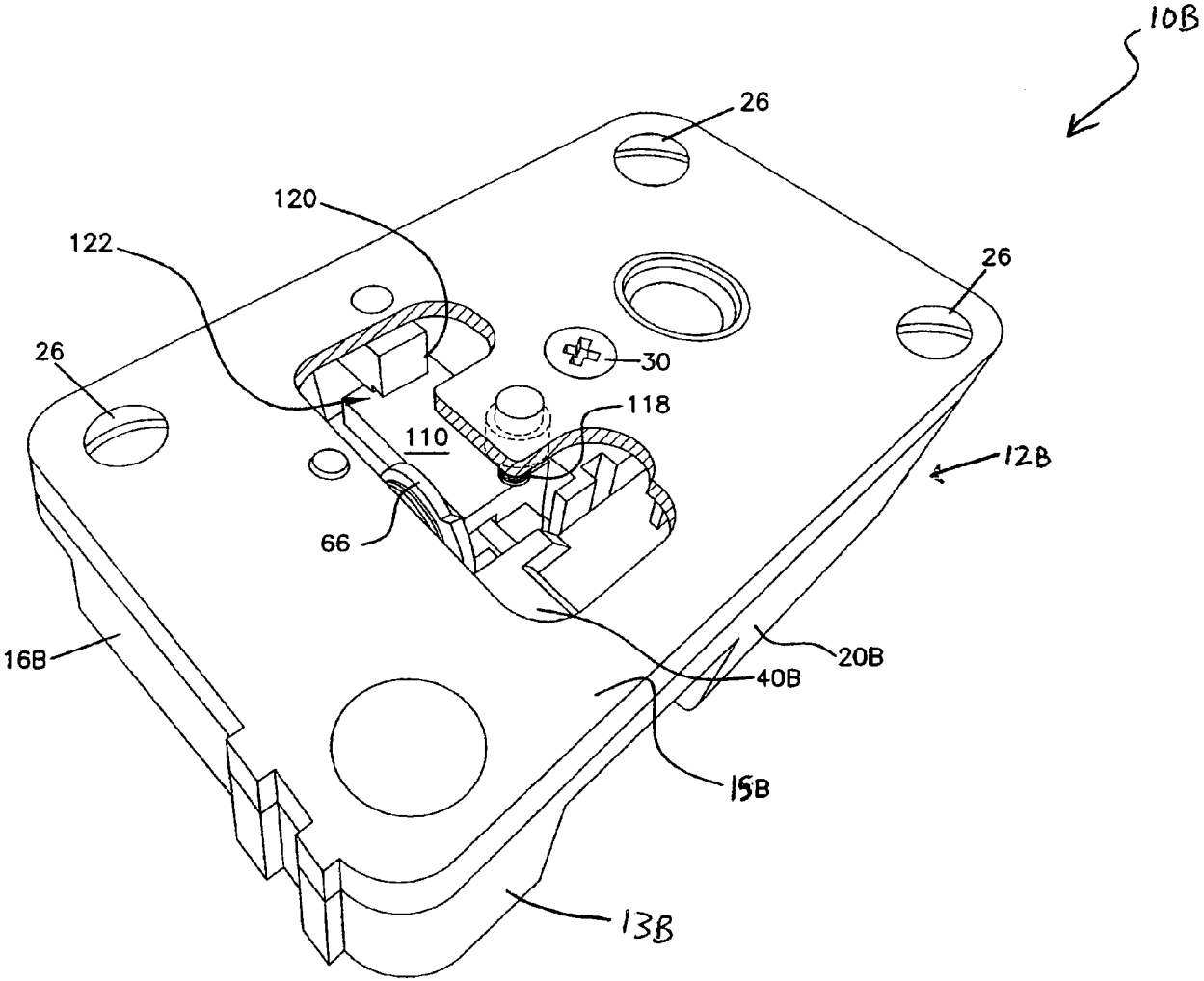
FIG. 9B is a perspective view of the lock of FIG. 8 illustrating the locking bolt and the blocking member in their unlocked positions.

FIG. 9B is a perspective view of lock 10B showing locking bolt 40B and blocking member 110 in their unlocked positions. In the unlocked position, tab member 68 has rotated such that flat portion 72 is adjacent to the bottom edge of blocking member 110, thus allowing locking bolt 40B to push blocking member 110 toward side 18B of housing 12B when the user rotates the door handle.

Spring 118 pushes against the top side of blocking member 110 as it slides toward side 18B, thereby allowing blocking member 110 to slide underneath tamper resistant block 120 so that locking bolt 40B may move to the unlocked position where extended portion 44B retracts within housing 12B. Thus, as illustrated in FIG. 9B, tamper resistant block 120 does not interfere with the normal movement of locking bolt 40B between the locked and unlocked positions.

Figure 10:
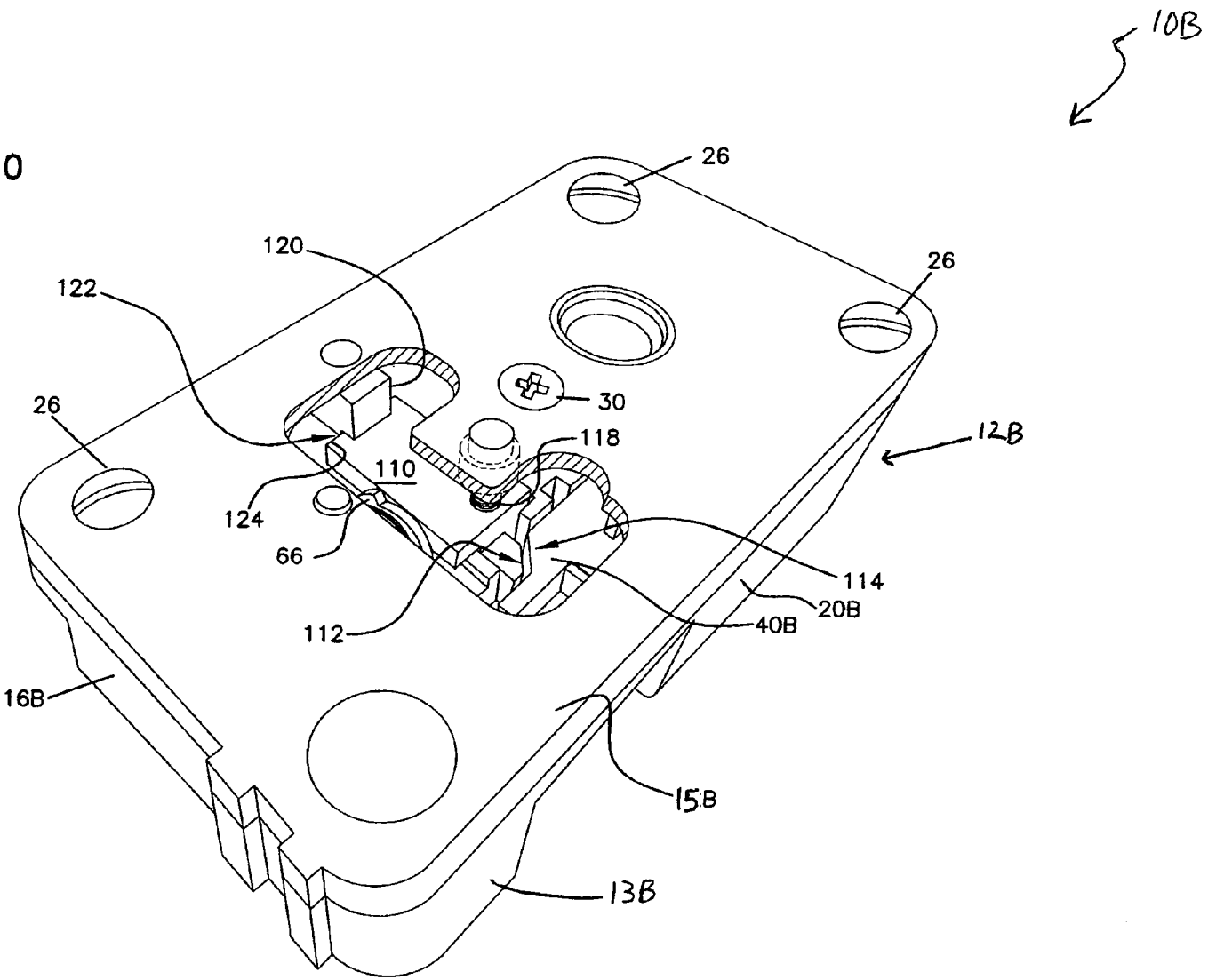
FIG. 10 is a perspective view showing the locking bolt blocked by a tamper resistant block in the housing in accordance with a second alternative embodiment of the present invention.

FIG. 10 illustrates an alternative embodiment of the "tamper-resistant" aspect of the locks. If the user attempts to force locking bolt 40B to the unlocked position, a force is applied to bolt 40B. Because the correct combination has not been entered, rounded portion 70 of tab member 68 remains engaged with the receiving groove in locking bolt 40B. If sufficient force is applied to locking bolt 40B, the bolt begins to slide toward the unlocked position. As a result, cam surface 114 of locking bolt 40B pushes against cam surface 112 of blocking member 110, thereby forcing blocking member 110 toward tamper resistant block 120.

As blocking member 110 slides toward tamper resistant block 120, rounded portion 70 of tab member 68 acts as a "ramping surface" to a mating surface of the receiving groove in blocking member 110, causing the blocking member to rise in an upward direction. As shown in FIG. 10, once sufficient force is applied to blocking member 110 via locking bolt 40B, an upper edge 124 of blocking member 110 engages with recessed portion 122 of tamper resistant block 120, thereby obstructing any further movement of locking bolt 40B toward the unlocked position. This limits the force that blocking member 110 applies on tab member 68 of disk 66 when tab member 68 is in the locked position. Consequently, blocking member 110 does not move far enough to allow locking bolt 40B to slide to the unlocked position. Therefore, the person who tries to force the lock cannot forcibly slide locking bolt 40B to the unlocked position and gain unauthorized access into the safe.

Although the present invention has been described with reference to preferred embodiments, workers skilled in the art will recognize that changes may be made in form and detail without departing from the spirit and scope of the invention.

I claim:

1. A lock comprising:

a housing having an opening for receiving a locking bolt, the locking bolt including a receiving groove thereon and being movable between a locked position and an unlocked position;

a rotary actuator positioned within the housing, the rotary actuator including a rotary shaft operably coupled thereto, the rotary actuator energizable between a locked condition for maintaining the locking bolt in the locked position and an unlocked condition that allows the locking bolt to move to the unlocked position;

a rotary blocking device operably coupled to the rotary shaft, said rotary blocking device including cam engagement means and a tab member co-axially operably attached to the cam engagement means, said tab member including a first portion engageable with said receiving groove and a second portion that is non-engageable with the receiving groove, wherein upon actuation, the rotary actuator alone causes the tab member to rotate by an angle greater than 90 degrees and less than 180 degrees between a locked position in which the first portion engages the receiving groove and an unlocked position in which the non-engageable second portion allows the locking bolt receiving groove to bypass the tab member, and a compression spring positioned between the rotary actuator and the cam engagement means for biasing the rotary blocking device in the locked position.

2. The lock of claim 1, wherein the locking bolt is a rotary locking bolt.

3. The lock of claim 1, further comprising a tamper resistant mechanism comprising a plurality of teeth in the housing, the plurality of housing teeth configured to mate with a plurality of teeth on the locking bolt thereby limiting rotational movement of the locking bolt upon application of force to the locking bolt.

4. The lock of claim 1, wherein the locking bolt is a rectilinear locking bolt.

5. The lock of claim 4 further comprising a tamper resistant mechanism, wherein the tamper resistant mechanism includes a flange member on an inner surface of the housing and a flange member extending perpendicularly from a surface of the locking bolt thereby limiting movement of the locking bolt along a longitudinal axis upon application of force to the locking bolt.

6. The lock of claim 1, wherein the rotary actuator is a rotary electromagnetic device.

7. The lock of claim 1 wherein the tab member is D-shaped in cross section and said first portion is a rounded portion and said second portion is a flat portion.

8. A lock comprising:

a housing having a disk cavity with first and second opposing side walls and an opening for receiving a locking bolt, the locking bolt movable between a locked position and an unlocked position;

a rotary actuator having a rotary output; and a rotatable cam engagement means responsive to the rotary output and positioned within said disk cavity and including a tab member fixed thereto and a stop member extending radially from said cam engagement means and including first and second sides, the tab member co-axially aligned with the rotatable cam engagement means and having a first portion that engages with a mating recess in the locking bolt and a second portion that is non-engageable with the mating recess in the locking bolt, wherein said tab member and said stop member are fixed to the rotatable cam engagement means such that the rotary actuator alone is operable to cause the rotatable cam engagement means, the stop member and the tab member to be rotatably energizable between a locked position in which the first portion of the tab member engages the mating recess of the locking bolt and the first side of the stop member engages the first side wall of the disk cavity, said engagement configured to limit the angular rotation of the cam engagement means to properly position tab member in the locked position and an unlocked position in which the second side of the stop member engages the second side wall of the disk cavity, said engagement configured to limit the angular rotation of the cam engagement means to properly position tab member in the unlocked position and the non-engageable second portion of the tab member is rotated adjacent the mating recess causing the locking bolt to by pass the non-engageable second portion.

9. The lock of claim 8, wherein the actuator is a rotary solenoid.

10. The lock of claim 8, wherein the locking bolt is a rotary locking bolt.

11. The lock of claim 8, wherein the locking bolt is a rectilinear locking bolt.

12. The lock of claim 8, wherein the locking bolt receiving groove and the tab member have a generally D-shape in cross section.

13. The lock of claim 8, wherein the rotatable cam engagement means is a rotatable disk.

14. The lock of claim 8 further comprising a spring disposed between the actuator and the cam engagement means for spring biasing the tab member in the locked position.

15. A lock assembly comprising:

a housing having an opening for receiving a locking bolt, the locking bolt movable between a locked position in which an extended portion of the locking bolt projects out the opening and an unlocked position in which the extended portion is within the housing, said housing defining a disk cavity therewithin, said disk cavity including first and second opposing side walls;

a rotary actuator positioned within the housing, the rotary actuator energizable between a locked condition for maintaining the locking bolt in the locked position and an unlocked condition that allows the locking bolt to move to the unlocked position;

electronic circuitry operable to transmit a signal to said rotary actuator to output a predetermined amount of rotation; and a rotary blocking device positioned within said disk cavity and responsive to the rotation output of said rotary actuator, said rotary blocking device comprising a rotatable disk co-axially aligned with a tab member for controlling movement of the locking bolt between the locked and unlocked positions and a stop member including first and second sides and extending radially from said rotatable disk, the tab member rotatable between a locked position and an unlocked position that correspond with the locked and unlocked positions of the locking bolt, wherein the rotary blocking device is fixed to a rotary output of the rotary actuator such that actuation of the rotary actuator alone causes rotation of the tab member by said predetermined amount between the locked position and the unlocked position wherein in the locked position the first side of the stop member engages the first side wall of the disk cavity, said engagement configured to properly position tab member in the locked position by limiting the angular rotation of the rotary blocking device, and further wherein in the unlocked position the second side of the stop member engages the second side wall of the disk cavity, said engagement configured to properly position tab member in the unlocked position by limiting the angular rotation of the rotary blocking device; and a spring member for biasing the rotary blocking device in the locked position.

16. The lock assembly of claim 15, wherein the tab member is configured to engage a receiving groove in the locking bolt.

17. The lock assembly of claim 16, wherein the tab member includes a first side having a generally rounded surface and a second side having a generally flat surface.

18. The lock assembly of claim 17, wherein the receiving groove in the locking bolt has a generally rounded surface configured to mate with the rounded surface of the tab member.

19. A lock comprising:

a housing having disk cavity with first and second opposing side walls and an opening for receiving a locking bolt;

a shaft in the housing for pivotally mounting the locking bolt within the housing such that the locking bolt pivots with respect to the shaft between a locked position in which an extended portion of the locking bolt projects out of the locking bolt opening and an unlocked position in which the extended portion is within the housing;

shaft receiving means in the housing for receiving the shaft and for permitting lateral movement of the shaft along the shaft receiving means, the shaft receiving means having first and second ends;

bias means extending between the shaft and the shaft receiving means for biasing the first end of the shaft receiving means toward the shaft; and rotary actuator means positioned within the disk cavity and energizable for controlling movement of the locking bolt between the locked position and the unlocked position, the rotary actuator means including a rotatable disk with a tab member and a stop member extending radially from said rotatable disk, said tab member and stop member fixed to a rotary output of the rotary actuator means such that actuation of the rotary actuator alone causes rotation of the rotatable disk, the stop member and the tab member by a predetermined amount from a position in which the tab member engages a receiving groove in the locking bolt when in the locked position and disengages from the receiving groove in the locking bolt when in the unlocked position wherein in the locked position a first side of the stop member engages the first side wall of the disk cavity, said engagement configured to limit the angular rotation of the rotary blocking device from the locked position and further wherein in the unlocked position a second side of the stop member engages the second side wall of the disk cavity, said engagement configured to limit the angular rotation of the rotary blocking device from the unlocked position.

20. The lock assembly of claim 19 further comprising a tamper resistant mechanism comprising a plurality of teeth in the housing and a corresponding plurality of teeth on the rotary locking bolt, wherein attempting to forcibly rotate the locking bolt from the locked position to the unlocked position while the actuator remains in the locked condition causes the plurality of teeth on the locking bolt to engage with the teeth in the housing.

* * * * *